United States Patent [19]

Ray et al.

[11] 4,191,489

[45] Mar. 4, 1980

[54] METHOD FOR IMPROVING LOAD TRANSFERS BETWEEN CONCRETE SLABS IN ZONES AT WHICH JOINTS ARE PROVIDED, AND MEANS FOR PERFORMING SAME

[75] Inventors: Michel Ray, Paris; Jean L. Nissoux, La Chevroliere, both of France

[73] Assignee: Etat Francais Represente par le Ministere de l'Environment et du Cadre de Vie Laboratorie Central des Ponts et Chaussees, Paris, France

[21] Appl. No.: 956,665

[22] Filed: Nov. 1, 1978

[30] Foreign Application Priority Data

Nov. 7, 1977 [FR] France ..... 77 33423

[51] Int. Cl.[2] ..... E01C 11/18

[52] U.S. Cl. ..... 404/51; 404/74; 52/396

[58] Field of Search ..... 404/56, 47, 59, 49, 404/51, 63, 74, 72, 71; 52/396, 401

[56] References Cited

U.S. PATENT DOCUMENTS

| | | | |
|---|---|---|---|
| 1,445,229 | 2/1923 | Miller | 404/56 |
| 1,586,326 | 5/1926 | Older | 404/51 |
| 2,106,944 | 2/1938 | Fischer | 404/49 |
| 2,108,393 | 2/1938 | Schulz | 404/52 |
| 2,125,857 | 8/1938 | Fischer | 404/56 |
| 3,104,600 | 9/1963 | White | 404/47 X |
| 3,217,616 | 11/1965 | Maxon | 404/59 |
| 3,677,145 | 7/1972 | Wattiel | 404/47 |

FOREIGN PATENT DOCUMENTS

| | | |
|---|---|---|
| 423002 | 9/1937 | Belgium . |
| 707212 | 6/1941 | Fed. Rep. of Germany . |
| 1625407 | 3/1972 | Fed. Rep. of Germany . |
| 2300250 | 7/1974 | Fed. Rep. of Germany . |
| 581480 | 11/1924 | France . |
| 858363 | 11/1940 | France . |
| 1225028 | 5/1962 | France . |
| 1397633 | 3/1965 | France . |
| 7100510 | 7/1972 | Netherlands . |

*Primary Examiner*—Nile C. Byers, Jr.
*Attorney, Agent, or Firm*—Bacon & Thomas

[57] ABSTRACT

In order to improve load tranfers between concrete slabs in zones at which joints are provided between said slabs, an elongated connection member, formed in one piece is fitted in the joint over at least part of the height of the slabs, which connection member is substantially cylindrical, adapted to be deformed over its entire length by compression or by expansion in at least one direction of deformation perpendicular to its axis. The connection member is placed astride the location of the joint with its axis situated substantially in the plane of the joint. The opposite portions, located on either sides of the plane of the joint, of the peripheral surface of the connection member are adhesively connected to the surfaces of the slabs with which they are in contact so as to prevent any relative movement between the contacting portions of the connection member and of the slabs.

15 Claims, 11 Drawing Figures

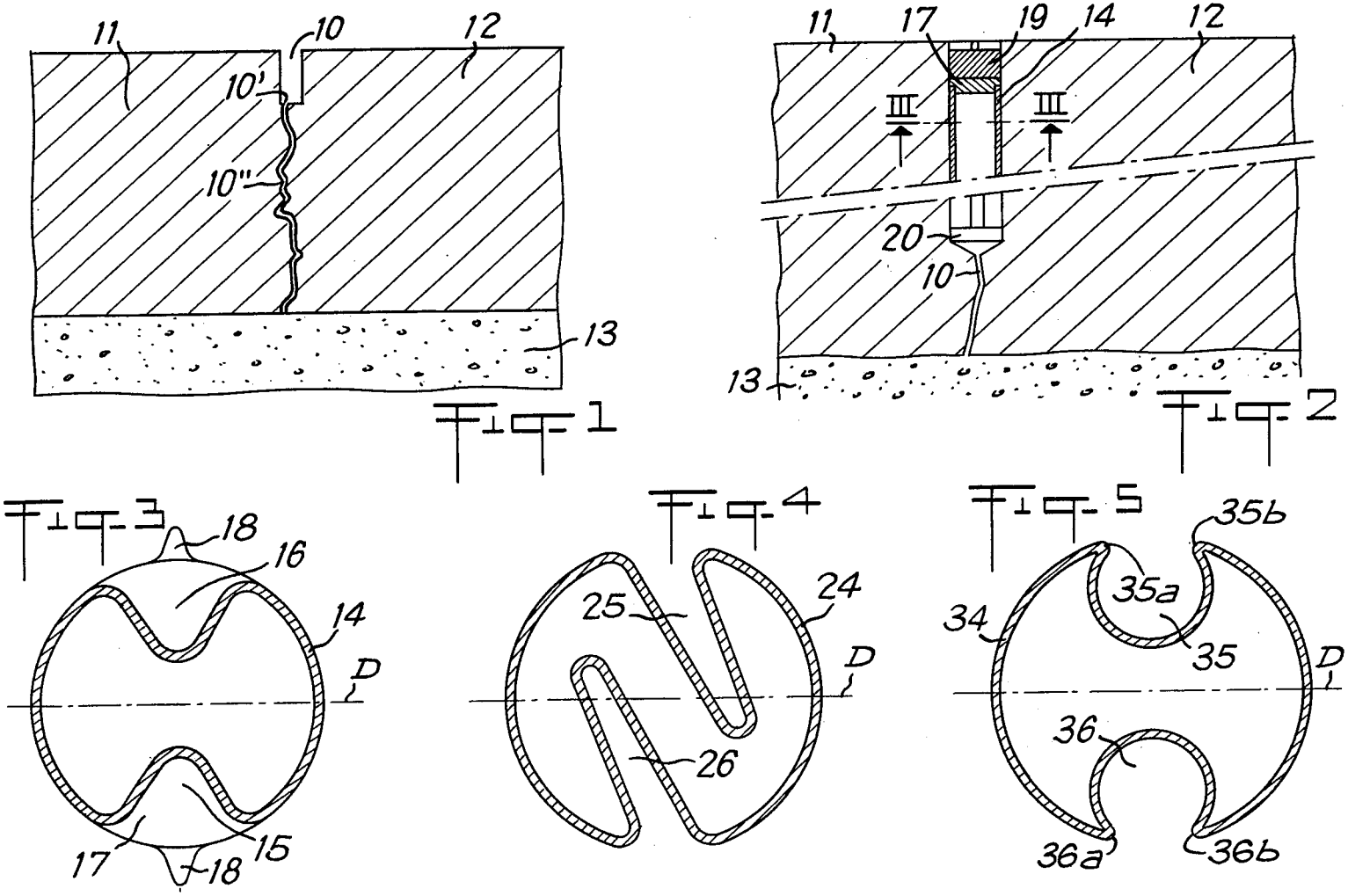
11
12
13
10
10'
10''
14
15
16
17
18
19
20
24
25
26
34
35
35a
35b
36
36a
36b
D
1
2
3
4
5

METHOD FOR IMPROVING LOAD TRANSFERS BETWEEN CONCRETE SLABS IN ZONES AT WHICH JOINTS ARE PROVIDED, AND MEANS FOR PERFORMING SAME

The present invention relates to a method for improving load transfers between sections of concrete pavements or slabs in zones at which joints or cracks are provided between said slabs.

The invention is particularly applicable in the case of concrete slabs in a pavement subjected to strong stresses, such as highways, airport runways or even factory floors.

Taking for example the case of a highway with a concrete pavement, it is known that it is of the greatest importance to ensure a load transfer from one side of each contraction joint or crack of the pavement to the other side, i.e. to ensure that there is not too much discontinuity at the joints level, in the transfer of any vertical deformations occuring in the pavement surface.

Some discontinuous pavements exist wherein the joints between the slabs are not dowel-connected, the load transfer being ensured by the engagement of the lips of the crack which has formed under the joint and by the layer of support material situated immediately below the concrete pavement. The formation of open joints at building time, because of special atmospheric conditions, of localized defects in the support layer and of the wearing down of the lips of the cracks are amongst the main causes which contribute to a lowering of the quality of the load transfer. The presence of water between the slab and the support layer, combined with the absence of load transfer, slowly causes, over long periods of time, some permanent vertical displacements of the slabs relative to each other, as well as the formation of cavities under the slabs on either sides of the crack. The injection of different products under the slab, which is a conventional mode of repair in such a case, has but a limited effect due to the fact that the load transfer is only partly restored. Moreover, new cavities may often occur sooner or later under the injected product.

When the pavement is a discontinuous pavement, constituted by reinforced or ordinary concrete slabs, the joints between the slabs predetermine the location of the cracks.

Continuous vertical deformations from one side of a joint to the other may then be ensured by dowels which are set in place at the time of the construction and are embedded in the slabs adjacent the joint. However, dowel-connected pavements are not always free from defects affecting load transfers. These may come from cracks occurring outside the joints or from other intermediate joints which are not dowelled and which have been provided in order to adapt the pavement to new traffic conditions. Repairs generally consist then in demolishing the pavement on either sides of the crack in order to place the dowels and in rebuilding the cracked slab. This again means rather lengthy and costly operations necessitating interruptions of traffic for rather considerable lengths of time.

When the pavement is a reinforced concrete continuous pavement, cracks occur at random and normally remain virtually closed because of the presence of the reinforcements. The mutual engagement of the lips of the crack ensure the load transfer. However, any manufacturing defect, or corroding of the reinforcement or any defect in the overlapping the reinforcements may result sooner or later in a widely opened crack which no longer ensures the transfer of the load, thereby accelerating the pavement degradation process. In order to be repaired, the pavement is normally demolished on either sides of the crack, so as to uncover the reinforcements, and to restore their continuity before rebuilding the slab. Such repairs are rather long and expensive, and necessitate a fairly long interruption of the traffic.

Finally, it will be noted that in the case of a discontinuous pavement, it is necessary when the frequency and the amplitude of the degradations increase, to load up the structure either with a running layer, 8 to 12 cm thick, or with another carrying layer, 6 to 8 cm thick. Depending on the nature and importance of the traffic, such operations should be renewed after, 4 to 8 years' service and 8 to 15 years' service, respectively.

It is therefore clear from the foregoing that the repair of a connection between concrete slabs adjacent a crack or a joint in order to restore the transfer of the load from one side of the joint to the other, is generally expensive and long, and its effect is limited.

The object of the present invention is to provide a method for connecting, safely and rapidly, two concrete slabs separated by a crack or a joint, whilst ensuring a load transfer between said slabs. A particular aim of the invention is the simple and rapid repair of an old pavement at the zone of its joints or cracks, not however excluding the case of the building of new pavement composed of concrete slabs separated by joints.

In the method according to the invention, at least one elongated connection member is provided, which is in one piece, and substantially cylindrical in its outer shape, adapted to be deformed over its entire length by compression or expansion in at least one direction, perpendicular to its axis, said connection member is placed astride the location of the joint so as to extend over at least part of the height of the pavement, it axis being situated substantially in the plane of the joint, and with the said direction of deformation situated substantially perpendicularly to the plane of the joint, and the opposite parts are caused to adhere, to the slab surfaces with which they are in contact so as to prevent any relative movement between the contacting portions of the connection member and of the slabs, the said connection member thus ensuring the transmission of any vertical deformations of the slabs from one side of the joint to the other whilst allowing any expansions or contractions of thermal origin in the slabs.

When working with an already existing pavement, for example when repairing a cracked pavement, at least one cylindrical recess is drilled astride the joint, in which recess is introduced said connection element.

In order to join the connection member to the slab faces adjacent the joint, the contacting surfaces of the connection member and of the slabs are, at least partly, adhesively connected.

As a variant, or additionally, it is possible to deform the connection member by compression in the said direction of deformation in order to introduce it into the said recess thereby conferring to the connection member fitted in the recess a prestressing force in compression so as to join together at least partly by friction or engagement, the contacting surfaces of the connection member and of the said recess.

Preferably, the cylindrical member is fitted in, substantially vertically, and in such a way that its upper end is situated below the pavement surface.

It is a further object of the invention to provide connection means for joining two parts of concrete pavement or slabs at zones where cracks or joints may be found between said slabs in order to ensure a load transfer from one side of the joint to the other.

Said means is according to the invention, constituted by at least one elongated connection member, formed in one piece, and substantially cylindrical, having on its periphery at least one indentation or a longitudinal lap, forming bellows, so that it can be deformed over its entire length by compression or expansion in at least one direction, perpendicular to its axis.

The cylindrical element may be for example a tube with a constant cross-section which can be inscribed in a circle and which is provided with at least one inward fold.

Other characteristics and advantages of the method and device according to the invention will be more readily understood on reading the following description, given by way of illustration and non-restrictively, reference being made to the accompanying drawing, in which:

FIG. 1 is a diagrammatic cross-sectional view showing a joint between slabs of the contrete pavement of a highway;

FIG. 2 is a diagrammatic cross-sectional view of a connecting member according to the invention fitted in a joint;

FIG. 3 is a cross-sectional view, on an enlarged scale, along III—III of FIG. 2;

FIGS. 4 to 7 are cross-sectional views showing variant embodiments of the connection member.

Figure 6:
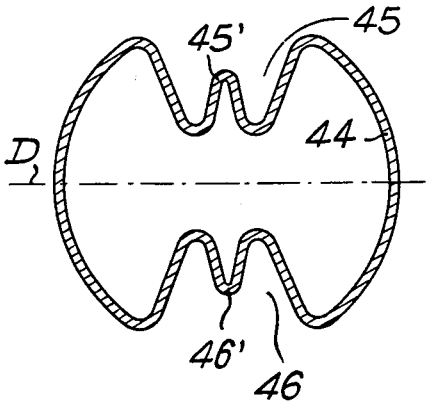

FIG. 1 illustrates very diagrammatically two adjacent slabs 11 and 12 of the concrete pavement of a highway, resting on a support layer or substrate 13, between which slabs a joint 10 is formed. This joint was marked at construction time by a groove 10', formed right from the pavement surface and extended downwards by a crack 10''. The load transfer from one slab to another, i.e. the transmission of the vertical deformations due to the forces exerted on the pavement surface, is ensured by the engagement of the lips of the crack 10'' and by the substrate 13.

In case of wearing down of the lips of the crack 10'', of deterioration of the substrate 13, of too wide an opening of the joint 10, etc. . . . , the load transfer is no longer ensured. To restore it, the present invention proposes to fit at least one connection member 14 (FIGS. 2 and 3) astride the joint 10.

The connection member 14 is constituted by a tube with a constant cross-section which can be inscribed in a circle. Said tube comprises two longitudinal inward indentations or folds 15, 16 which are symmetrical with respect to its axis, which indentations define bellows conferring to the tube a capacity of deformation under compression and expansion in a direction D perpendicular to the axis of the tube.

The connection member 14 is fitted as follows:

A recess 20 of a diameter substantially equal to that of the connection member is drilled astride the joint 10 and substantially vertically over the greatest part or over the totality of the height of the pavement. The peripheral surface of the connection member 14 and the inner wall of the bore 20 are adhesively joined with for example an epoxyde-type adhesive. The member 14 is introduced in the recess 20, the direction D being perpendicular to the plane of the joint, the bellows 15, 16 thus opening out into that plane which plane is that from side of which extend the surfaces of the slabs 11, 12 adjacent the joint 10 at the zone where the recess 20 is drilled. The axis of the member 14, is situated substantially in the plane of the joint.

The adhesion between the portions of opposite faces of the slabs 11 and 12 adjacent the recess 20 and the portions of the peripheral surface of the connection member, should be sufficient to withstand any thermal contraction has to be wholly absorbed by the expansion of the bellows 15 and 16 of the connection member without the said slabs and connection member coming apart anywhere. It will be noted on this point that it is preferable for the ambient temperature not to be too high when the said connection member is fitted in.

Once fitted in, the connection member 14 ensures the transfer of loads from one side of the joint 10 to the other because of its adhesion to the opposite faces of the slabs 11 and 12 and it absorbs any expansion and contraction of thermal origin occurring, due to its deformability in the direction D. In the case of highways, for example, such expansions and contractions have an amplitude of the order of one millimeter.

Other similar connection members may of course be fitted on the same joint depending on the length of the latter and of the loads supported by the pavement.

The connection member 14 is set in, substantially vertically, with its upper end below the pavement surface. Said upper end is advantageously provided with a cap 17 which seals it off thereby protecting the inside of the tubular member 14. The cap 17 is for example made from a soft plastic material cast directly on the end of the connection member. Two lugs 18 (FIG. 3) may be provided at diametrically opposite parts of the cap to serve for example as reference points when fitting in the connection member 14, said lugs having, in the example shown, to be in alignment with the joint 10.

Once the member 14 is fitted, a further sealing piece 19 may be placed in that part of the bore 20 which is situated above the cap 18.

Although it has been, hereinbefore, considered to joint the member 14 to the opposite faces of the bore 20 by adhesive connection, said connection can be either replaced or completed by a frictional connection obtained by imposing upon the member 14, at fitting time, prestresses in compression. This may be produced for example by deforming under compression the member 14 when this is being fitted, by means of a sleeve clamping said member and from which it is progressively freed by introducing it into the recess 20.

FIGS. 4 to 7 illustrate, cross-sectionally, variants of embodiment of the connecting member.

The connection member 24 shown in FIG. 4 is a tube with two relatively deep, longitudinal indentations 25, 26 starting from zones on opposite sides of the periphery of the member 24. Said indentations 25, 26 extend substantially parallel and symmetrically with respect to the axis of the member 24, thereby giving the cross-section of the member 24 substantially the shape of an S. Said indentations 25, 26 constitute the bellows of the element 24, which bellows open out into zones that are symmetrical with respect to the diametrical plane containing the direction of deformation D. Just as the member 14, the member 24 has a peripheral surface which can be inscribed in a circle so as to be fitted in a bore drilled on a joint of a concrete pavement.

FIG. 5 illustrates a tubular connection member 34, provided with two bellows 35, 36 which are symmetrical with respect to the diametrical plane containing the direction of deformation D. Said bellows 35, 36 are round in cross-section and open outwardly with close together lips 35*a*, 35*b*, 36*b*, thereby giving the member 34 a cross-section substantially in the shape of an X. As in the foregoing, the connecting member has a cross-section which may be inscribed in a circle.

The connection member 44 shown in FIG. 6 is similar in shape to that shown in FIG. 3, with two indentations or bellows 45, 46 which are symmetrical with respect to the diametrical plane containing the direction D and flaring outwardly. Said member 44 however, comprises an additonal fold 45', 46', at the bottom of each bellows the effect of which is to split up said latter.

Figure 7:
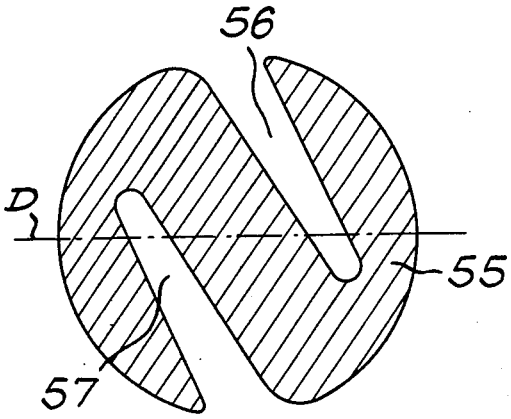

FIG. 7 shows a connection member 54 which differs from connection members 14, 25, 34 and 54 by the fact that it is constituted by a bar having a circular cross-section wherein two rather deep notches or grooves 55, 56 have been made. Said notches constitute bellows arranged in the same way as those of the member 24 which is shown in FIG. 4, thereby giving the elememt 54 a substantially S-shaped cross-section.

The connection members shown in FIGS. 3 to 7 may be metallic, of steel for example. That (14) shown in FIG. 3, may be produced by cold-drawing. The members (24,34) shown in FIGS. 4 and 5 may be obtained by hot or cold rolling or burnishing, and even by drawing, such as that shown in FIG. 6. Finally, the connection member 54 may be produced by machining a solid bar.

As a variant, the connection members may be produced in plastics, reinforced for example by glass fibres.

As already indicated in the foregoing, the connection member is adhesively and/or frictionally joined to the opposed sides of the slabs, between which it improves the transfer of the loads.

In the case of a connection ensured at least partly by friction, it may prove advantageous to reinforce the stress exerted against the sides of the slabs by the connection member when said latter is deformed by compression.

Figure 10:
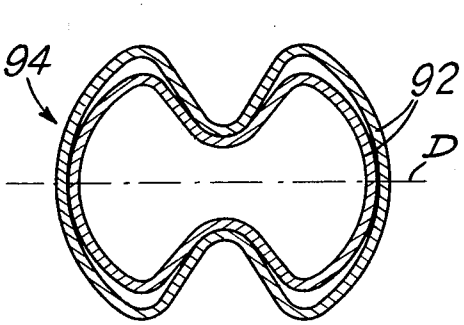
FIGS. 8 to 11 are diagrammatic cross-sectional views of other embodiments of a connection member according to the invention.
Figure 8:
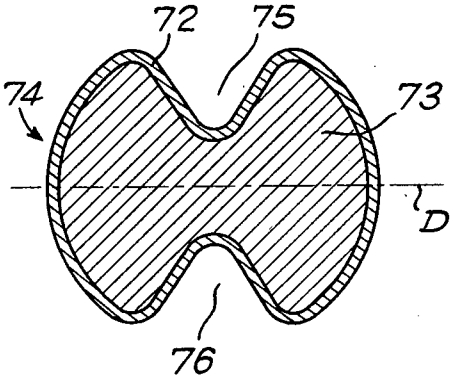
Figure 9:
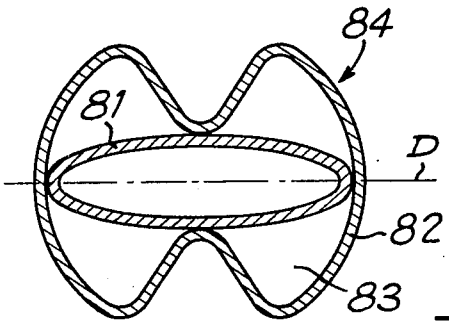

FIGS. 8 to 10 are diagrammatical cross-sections of connection members comprising each a tubular part with at least one longitudinal indentation forming bellows and means, inside the tube, for increasing the forces which can be called upon by elastic deformation of the tubular piece.

The connection member 74 shown in FIG. 8 is constituted by a hollow and deformable tubular piece 72, for example of the type shown in FIGS. 3 to 7. The inside volume 73 of said connection member is filled with a resilient material, such as an elastomer, which adheres to the inner wall of the piece 72.

The piece 72 is provided with at least two longitudinal bellows 75, 76 which can also be filled with elastomer, thereby further increasing the resilient return force generated after deformation of the member 74 along its direction of deformation D.

Material in powder form, such as sintered materials, may be included in the elastomer in order to increase the apparent modulus, and possibly, reduce the necessary volume thereof.

FIG. 9 shows, in cross-section, a connection member 84 constituted by a deformable tubular part 82 extended over its entire length along a direction D, such as for example a part of the type shown in FIGS. 3 to 7.

On the inside 83 of the part 82 are introduced vertically one or more metal parts 81 which, by their shape and their nature, exert a resilient return force which is sufficient to ensure the connection between the member 84 and the sides of the concrete slabs between which it is placed. Said metal parts 81 are forcefully introduced in the part 82 before or after the fitting of said latter into the pavement. They are for example constituted by cup springs or by thin slices of cylinder having, at least in the direction of deformation D, a dimension in the free state which is greater than that of the inside 83 of the part 82.

The connection member 94 shown in cross-section in FIG. 10 is constituted by a plurality of deformable tubular pieces 92 deformable along a similar direction D such as those shown in FIGS. 3 to 7. Said pieces are similarly-shaped and fit longitudinally and possibly forcibly into one another. They are joined by welding or riveting together their contacting surfaces. The number of pieces 92 is determined by to the force to be exerted against the side of the slabs and in relation to the force which may be created in each one of them.

Figure 11:
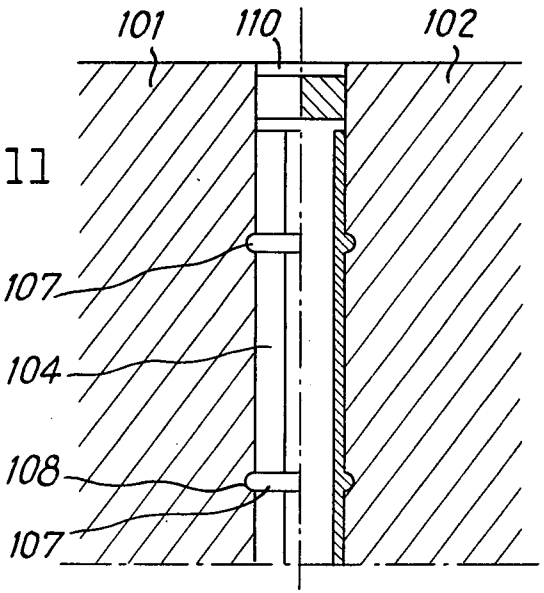

The connection by adhesion and/or by friction between the member fitted in the pavement and the sides of the slabs may further be completed, vertically, by an engagement connection, using a connection member of the type 104 half of which is shown in longitudinal section in FIG. 11.

The connection member 104 is constituted by a deformable tube provided with bellows, such as those shown in FIGS. 3 to 6, an having one or more circular bosses 107 on its outer surface.

Said bosses 107, annular ones for example, are introduced in recesses 108 of corresponding shape which are provided in the opposite sides of the concrete slabs 101, 102 between which the member 104 is fitted. The machining of the recesses 108 is done after drilling the hole 110 due to receive the member 104, the fitting in of said latter being produced with prior resilient deformation thereof under compression.

The preceding description considers the fitting of a connection member in an already existing pavement for example to restore a transfer of load where a joint is open. It is clear that the method according to the invention shows, compared with already known methods of repair, some considerable advantages which are related to the simple and rapid way in which it can be performed. Indeed, there is no need to proceed to any even partial demolishing or rebuilding of the slab. It is sufficient to drill at least one hole astride the joint and to introduce therein the connection member.

Nevertheless, the fixing of connection members similar to those described hereinabove, may also be considered when the pavement is being built, the connection between said members and the concrete being produced for example by way of an adhesive capable of adhering to the soft concrete. The connection with the soft concrete can even be further improved by providing annular and/or longitudinal projections, or grooves or bosses, on the periphery of the connection member, which projections are used for anchoring-in the slabs whilst the concrete is setting.

Other modifications or additions may of course be made without departing from the scope of protection defined by the accompanying claims.

We claim:

1. Load transfer means for a joint between two adjacent slabs in a concrete pavement having an upper surface, said means comprising at least one elongated, substantially cylindrical connection piece having an axis and adapted to be easily deformed over its entire length by transverse deformation in at least one direction of deformation substantially perpendicular to its axis, said piece being disposed so that its axis extends substantially vertically and in the plane of the joint between said two slabs, the said direction of deformation being arranged substantially perpendicular to the plane of the joint, said piece being in contact with both of said slabs with the contacting portions being on opposite sides of the axis of the connection piece and being adhered to the respective slabs so as to prevent any relative movement between said contacting portions and the respective slabs, whereby vertical solicitation is transmitted from one slab to the other through said connection piece without impairing free horizontal expansion or contraction of said slabs.

2. Means as claimed in claim 1, wherein at least one cylindrical recess extends from the upper surface of the pavement and astride the joint, in which recess the said connection piece is disposed.

3. Means as claimed in claim 2, wherein the said recess, is substantially vertical.

4. Means as claimed in claim 2, wherein the connection piece is prestressed in the said direction of deformation so as to adhere to the respective slabs at least partly by friction between the surfaces of the contacting portions and of the said recess.

5. Means as claimed in claim 1, wherein said connection piece has on its periphery at least one indentation defining a bellows allowing deformation of said piece in a direction perpendicular to its axis.

6. Means as claimed in claim 5, wherein the connection piece is a tube of constant cross-section which can be inscribed in a circle and which is provided with at least one outward fold.

7. Means as claimed in claim 6 wherein the tube is sealed off by a sealing cap.

8. Means as claimed in claim 5, wherein the connection piece is a tubular member with at least one means longitudinal indentation defining said bellows, and further means are provided inside the tube to increase the forces created by resilient deformation of the tubular part.

9. Means as claimed in claim 8, wherein the tubular part is filled with an elastomer.

10. Means as claimed in claim 8, wherein said further means is a tubular member adapted to be resiliently deformed, in the direction of deformation of the tubular member, when said latter is deformed.

11. Means as claimed in claim 1, wherein the contacting portions of the connection and adjacent parts of the respective slabs are at least partly adhesively connected.

12. Means as claimed in claim 1, wherein the said connection piece is positioned with its upper end situated below the pavement upper surface.

13. Means as claimed in claim 1, wherein the connection piece is a bar with a constant circular cross-section provided with at least one longitudinal groove.

14. Means as claimed in claim 1, wherein said connection piece is provided in said pavement when the pavement is built, and the connection between said piece and the concrete is produced at least partially by an adhesive capable of adhering the soft concrete.

15. A method for improving load transfers between a portion of concrete pavement having a crack therein and having an upper surface and side edges, said crack defining a plane lying between said edge surfaces of said pavement, said method comprising the steps of drilling a cylindrical recess from the upper surface of said pavement and astride said crack;

introducing in said recess at least one connection piece having an axis and adapted to be easily deformed over its entire length by transverse deformation in at least one direction of deformation substantially perpendicular to its axis, with the axis of said piece disposed substantially vertically and in the plane of the crack;

causing said piece to adhere to both of the edge surfaces of said crack by two respective contacting portions of said pieces so as to prevent any relative movement between said contacting portions and the respective edge surfaces of the crack.

* * * * *